United States Patent [19]

Lubin

[11] 4,240,370

[45] Dec. 23, 1980

[54] PROPULSION SYSTEM FOR HYDROFOIL, PLANING AND SEMI-PLANING SEA-GOING VESSELS

[76] Inventor: Louis Lubin, 87-01 Midland Pkwy., Jamaica Estates, N.Y. 11432

[21] Appl. No.: 968,484

[22] Filed: Dec. 11, 1978

[51] Int. Cl.[3] ..... B63H 11/04

[52] U.S. Cl. ..... 440/40; 60/222

[58] Field of Search ..... 115/11, 12 R, 14, 16, 115/37; 60/221, 222

[56] References Cited

U.S. PATENT DOCUMENTS

| | | | |
|---|---|---|---|
| 733,882 | 7/1903 | Taylor | 115/14 |
| 1,577,101 | 3/1926 | Beitzell et al. | 115/37 |
| 3,279,704 | 10/1966 | Englehart et al. | 115/14 X |
| 3,985,094 | 10/1976 | Stricker | 115/16 X |

FOREIGN PATENT DOCUMENTS

| | | | |
|---|---|---|---|
| 2035857 | 2/1972 | Fed. Rep. of Germany | 115/11 |

*Primary Examiner*—Sherman D. Basinger
*Attorney, Agent, or Firm*—Daniel Jay Tick

[57] ABSTRACT

A propulsion system for a hydrofoil, planing or semi-planing sea-going vessel having a hull having a port pump water inlet formed therethrough on its port side, a starboard pump water inlet formed therethrough on its starboard side and first, second and third outlets formed therethrough, comprises a booster first stage system in the hull coupled to and driven by the motors. The booster first stage system comprises a first axial water jet pump at the port pump water inlet and a second axial water jet pump at the starboard pump water inlet. A second stage water jet system in the hull aft of the first stage system comprises a third axial water jet pump functioning as a turbocharger. Water ducts are provided in the hull from each of the pump water inlets through the corresponding one of the first and second pumps to the corresponding one of the first and second water outlets, from each of the pump water inlets through the corresponding one of the first and second pumps and thence through the third pump, to the third water outlet, and from each of the pump water inlets through the third pump to the third water outlet, bypassing the first and second pumps. A control system selectively directs a water flow through the first and second pumps simultaneously, through the first pump solely, through the second pump solely, through the third pump solely, through the first and second pumps and the third pump simultaneously, through the first pump and the third pump simultaneously and through the second pump and the third pump simultaneously.

6 Claims, 3 Drawing Figures

PROPULSION SYSTEM FOR HYDROFOIL, PLANING AND SEMI-PLANING SEA-GOING VESSELS

BACKGROUND OF THE INVENTION

The present invention relates to a propulsion system. More particularly, the invention relates to a propulsion system for hydrofoil, planing and semi-planing sea-going vessels.

Marine or sea-going vessels may be damaged due to malfunction of equipment and may be inoperable due to the need for replacement or overhauling of machinery. Naval vessels are not only susceptible to these difficulties, but may be damaged in action, as well. It is of extreme importance that naval vessels and certain types of commerical vessels be maintained in sound operating condition and that any malfunction or damage be remedied in very short time periods. Also, when a vessel is at sea and suffers malfunction or damage, it is essential that the vessel be able to proceed under its own power to its destination.

The principal object of the present invention is to provide a propulsion system for hydrofoil, displacement planing and semi-planing sea-going vessels, which propulsion system is of simple structure and functions to maintain operable power in the vessel although such vessel suffers malfunction and/or damage.

Another object of the invention is to provide a propulsion system of simple structure, which functions economically and efficiently to maintain damaged hydrofoil, displacement planing and semi-planing marine vessels in operation under adverse conditions, including damage and malfunction of the vessel.

Another object of the invention is to provide a propulsion system for hydrofoil, displacement planing and semi-planing sea-going vessels, which system insures peak performance of the vessel although part of the system is inoperable due to malfunction, damage, or the like.

Still another object of the invention is to provide a propulsion system for hydrofoil, planing and semi-planing sea-going vessels, which propulsion system functions efficiently, effectively and reliably to maintain a vessel almost completely operable although part of such system is totally inoperable.

Yet another object of the invention is to provide a propulsion system for hydrofoil, planing and semi-planing marine vessels, which propulsion system maintains operability and maneuverability of the vessel although 50% to 75% of its machinery is damaged or malfunctioning.

Another object of the invention is to provide a hydrofoil, planing and semi-planing vessel propulsion system of simple structure, which is economical in operation, used with facility and convenience, and functions efficiently, effectively and reliably to operate and steer a marine vessel although most of its machinery is non-operative.

Yet another object of the invention is to provide a propulsion system for hydrofoil, displacement planing and semi-planing sea-going vessels, which propulsion system results in considerable economy of fuel consumption.

BRIEF SUMMARY OF THE INVENTION

In accordance with the invention, a propulsion system for hydrofoil, planing and semi-planing sea-going vessels, said vessels having a hull with a bow, a stern, a port side and a starboard side, the hull having a port pump water inlet formed therethrough on its port side, a starboard pump water inlet formed therethrough on its starboard side and first, second and third water outlets formed therethrough, comprises turbines in the hull. A booster first stage system in the hull is coupled to, and driven by, the turbines. The booster first stage system comprises a first axial water jet pump at the port pump water inlet for pumping water from the port pump water inlet and a second axial water jet pump at the starboard pump water inlet for pumping water from the starboard pump water inlet. A second stage water jet system is provided in the hull aft of the first stage system and comprises a third axial water jet pump functioning as a turbocharger. Water ducts are provided in the hull from each of the pump water inlets through the corresponding one of the first and second pumps to the corresponding one of the first and second water outlets, from each of the pump water inlets through the corresponding one of the first and second pumps and thence through the third pump and from each of the pump water inlets through the third pump to the third water outlet, bypassing the first and second pumps. A flow direction control system selectively directs a water flow through the first and second pumps simultaneously through the first pump solely, through the second pump solely, through the third pump solely, through the first and second pumps and the third pump simultaneously, through the first pump and the third pump simultaneously and through the second pump and third pump simultaneously.

The turbines comprise a first group of gas turbines, a second group of gas turbines, first gear means coupling the first group of gas turbines to the first pump and second gear means coupling the second group of gas turbines to the second pump.

The flow direction control system includes a plurality of flow direction control devices at a plurality of locations in the water ducts for controlling the direction and volume of water flowing through the water ducts at the locations.

The flow velocity control system controls the velocity of water pumped by each of the first and second pumps thereby controlling the velocity of water at the water outlets and, accordingly, the velocity of the vessel.

The flow velocity control system comprises first and second variable orifices in the water ducts between the third pump and each of the first and second pumps, respectively, and a flow velocity control unit coupled to the orifices for selectively varying the orifices thereby selectively varying the velocity of water pumped by each of the first and second pumps and controlling the velocity of water at the water outlet and, accordingly, the velocity of the vessel.

The water ducts from each of the first and second pumps to the first and second water outlets, respectively, comprise a first duct. The water ducts from each of the first and second pumps to the third pump comprises a second duct extending with the corresponding first duct in common from a third duct part at each of the first and second pumps. Each of the third duct parts has a predetermined cross-sectional flow area. Flow area varying devices are mounted in each of the third duct parts for varying the flow area of water leaving the first and second pumps. Flow control devices are coupled to the flow area varying devices for selectively varying the flow area from a minimum area whereby water flows to the third pump at a maximum velocity to a maximum area whereby water flows to the third pump at a minimum velocity.

BRIEF DESCRIPTION OF THE DRAWINGS:

In order that the invention may be readily carried into effect, it will now be described with reference to the accompanying drawings, wherein.

DETAILED DESCRIPTION OF THE INVENTION

Figure 2:
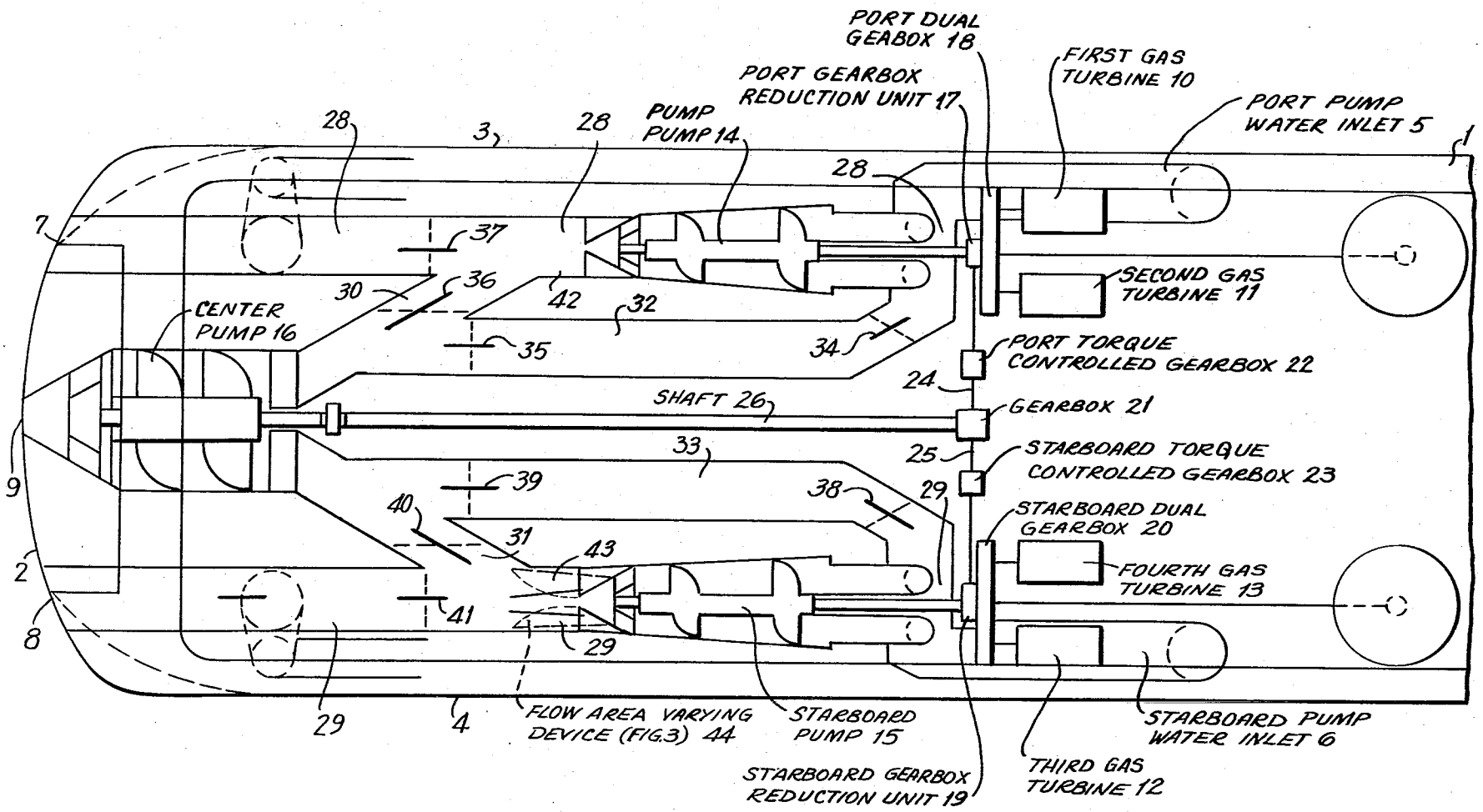
FIG. 2 is a schematic diagram of the embodiment of FIG. 1, as installed in a sea-going hydrofoil, displacement planing or semi-planing marine vessel.

The propulsion system of the invention is for a hydrofoil, displacement planing, semi-planing, and the like, sea-going or marine vessel having a hull 1 with a bow (not shown in the FIGS.), a stern 2, a port side 3 and a starboard side 4 (FIG. 2). The hull 1 also has a port pump water inlet 5 formed therethrough on its port side, a starboard pump water inlet 6 formed therethrough on its starboard side and first, second and third water outlets 7, 8 and 9, respectively, formed therethrough, as shown in FIG. 2. The first, second and third water outlets 7, 8 and 9 are preferably at the stern 2 of the vessel, at the port, starboard and center thereof, although they may be positioned wherever expedient.

Figure 1:
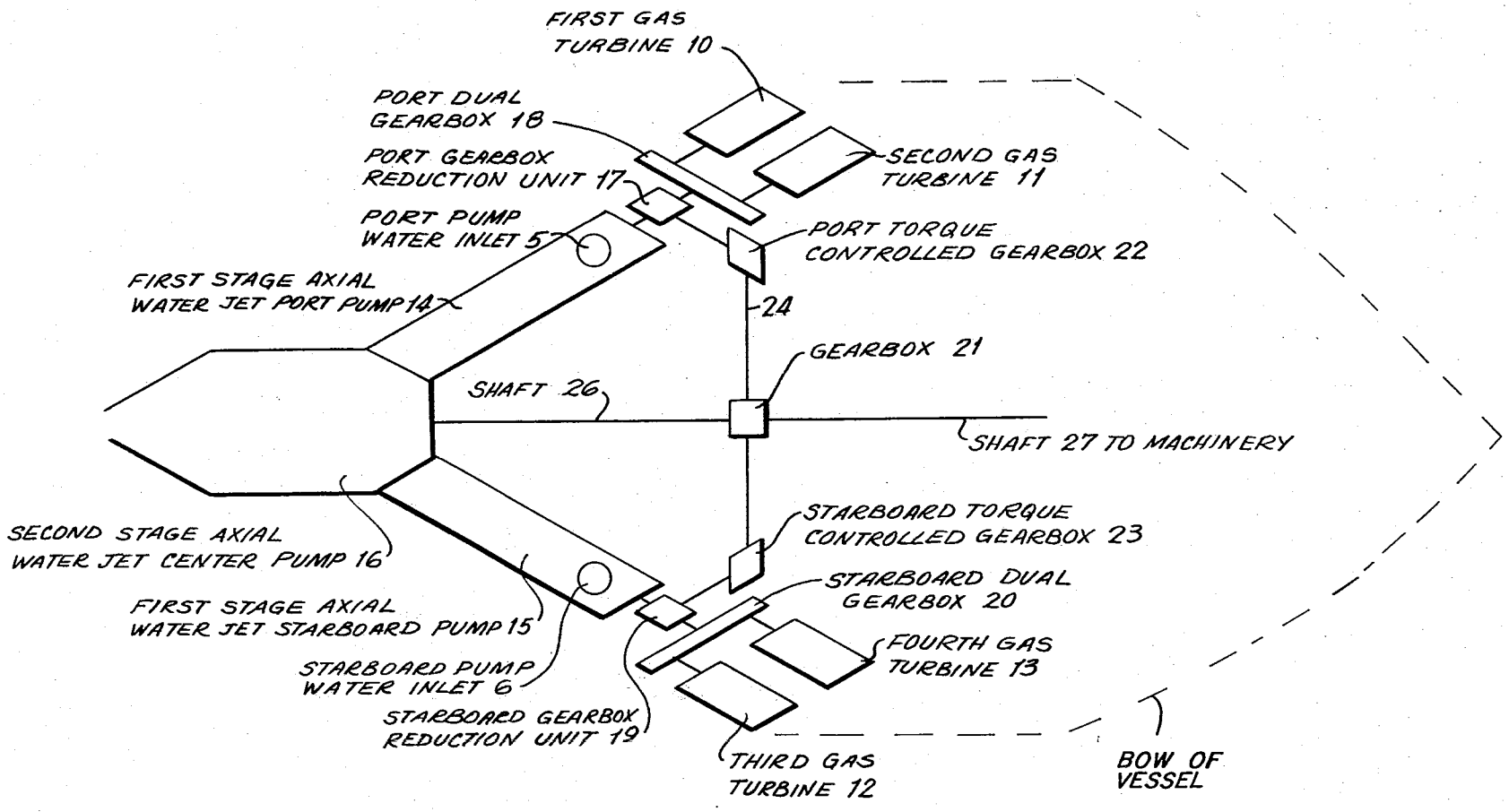
FIG. 1 is a block diagram of an embodiment of the propulsion system of the invention.

The propulsion system of the invention comprises a motive system consisting of a first group, including first and second gas turbines 10 and 11 and a second group, including third and fourth gas turbines 12 and 13 (FIGS. 1 and 2). The first group of gas turbines 10 and 11 constitutes the port group and the second group of gas turbines 12 and 13 constitutes the starboard group. Each of the gas turbines 10 to 13 may comprise any suitable turbine such as for example, a 7000 HP Allison gas turbine manufactured by Detroit Diesel Allison, Division of General Motors Corporation, Indianapolis, Indiana 42606, known as Model 570K.

A booster first stage system in the hull 1 is coupled to, and driven by, the turbines 10 to 13 in a manner hereinafter described. The booster first stage system comprises a first or port axial water jet pump 14 at the port pump water inlet 5 for pumping water from the port pump water inlet and a second or starboard axial water jet pump 15 at the starboard pump water inlet 6 for pumping water from the starboard pump water inlet (FIGS. 1 and 2). Each of the first stage port and axial water jet pumps 14 and 15, respectively, preferably has an input power of 14,000 HP, an input speed of 4000 RPM, a flow rate of 90,000 gallons per minute and a thrust static of 80,000 pounds.

A second stage water jet system is provided in the hull 1, aft of the first stage system and comprises a third or center axial water jet pump 16 which preferably develops 320,000 pounds of thrust and has a maximum output flow rate of 300,000 gallons per minute. The center pump 16 functions as a turbocharger.

The first and second gas turbines 10 and 11 are coupled to a port gearbox reduction unit 17 via a port dual gearbox 18 (FIGS. 1 and 2). The third and fourth gas turbines 12 and 13 are coupled to a starboard gearbox reduction unit 19 via a starboard dual gearbox 20 (FIGS. 1 and 2). The port and starboard gearbox reduction units 17 and 19 are identical and constitute any suitable gearbox which reduces 11,000 RPM to 4000 RPM. The port and starboard dual gearboxes 18 and 20 are identical and constitute any suitable dual gearbox. The port gearbox reduction unit 17 is coupled to a gearbox 21 via a port torque controlled gearbox 22 and the starboard gearbox reduction unit 19 is coupled to the gearbox 21 via a starboard torque controlled gearbox 23 (FIGS. 1 and 2). The port and starboard torque controlled gearboxes 22 and 23 are identical and constitute any suitable gearbox for increasing 4000 RPM to 16,000 RPM. The gearbox 21 may comprise any suitable gearbox for coupling the port and starboard torque controlled gearboxes 22 and 23 to the center pump 16 and to machinery and equipment, including turbines, and the like, aboard the vessel. The gearbox 21 thus couples the port and starboard torque controlled gearboxes 22 and 23, via input shafts 24 and 25, respectively, to a shaft 26 which is coupled to the center pump 16 (FIGS. 1 and 2) and a shaft 27 which is coupled to machinery in the vessel (FIG. 1).

A water duct system is provided in the hull 1 from each of the port and starboard pump water inlets 5 and 6 through the corresponding one of the port and starboard pumps 14 and 15 to the corresponding one of the port and starboard water outlets 7 and 8, respectively, from each of said water inlets through the corresponding one of said port and starboard pumps and thence through the center pump 16 to the center water outlet 9, and from each of said water inlets through said center pump to said center water outlet, bypassing said port and starboard pumps. Thus, as shown in FIG. 2, the water duct system comprises a first water duct 28 from the port pump water inlet 5 through the port pump 14 to the port water outlet 7 and a second duct 29 from the starboard pump water inlet 6 through the starboard pump 15 to the starboard water outlet 8, as shown in FIG. 2. The water duct system further comprises a third water duct 30 from the port pump water inlet 5 through the port pump 14, via the water duct 28, and thence through the center pump 16 to the center water outlet 9 and a fourth water duct 31 from the starboard pump water inlet 6, through the starboard pump 15, via the second water duct 29, through said center pump to said center water outlet, as shown in FIG. 2. Furthermore, the water duct system comprises a fifth water duct 32 from the port pump water inlet 5 through the center pump 16 to the center water outlet 9 and a sixth water duct 33 from the starboard pump water inlet 6 through said center pump to said center water outlet, as shown in FIG. 2. The fifth and sixth water ducts 32 and 33, respectively, thus bypass the port and starboard pumps 14 and 15, respectively.

A flow direction control system selectively directs a water flow through the port and starboard pumps 14 and 15 simultaneously, through said port pump solely, through said starboard pump solely, through said center pump solely, through said port and starboard pump and said center pump simultaneously, through said port pump and said center pump simultaneously, and through said starboard pump and said center pump simultaneously. This is accomplished by a plurality of flow direction control devices or valves 34, 35, 36, 37, 38, 39, 40 and 41 (FIG. 2). The flow direction control devices 34 to 41 are provided, as shown in FIG. 2, at a plurality of locations in the water ducts 28, 29, 30, 31, 32 and 33 and function to control the direction and volume of water flowing through said water ducts at said locations. Each of the flow direction control devices 34 to 41 may comprise any suitable device such as, for example, a valve, for controlling the flow of water through the duct from a minimum flow of essentially zero gallons per minute to a maximum flow essentially equal to that which would occur if the flow direction control device were absent.

When the flow direction control devices 34 and 36 are moved, to their positions, at right angles to those shown in FIG. 2, so that they impede the flow of water through the water ducts 32 and 30 at the locations of said devices, and the flow direction control device 37 is moved, as shown in FIG. 2, so that it permits a maximum flow of water through the water duct 28 at its location, water flows from the port pump water inlet 5 through the port pump 14 to the port water outlet 7 thereby powering the vessel via said port pump. When the flow direction control devices 38 and 40 are moved to their positions, at right angles to those shown in FIG. 2, so that they impede the flow of water through the water ducts 33 and 31 at the locations of said devices, and the flow direction control device 41 is moved, as shown in FIG. 2, so that it permits a maximum flow of water through the water duct 29 at its location, water flows from the starboard pump water inlet 6 through the starboard pump 15 to the starboard water outlet 8 thereby powering the vessel via said starboard pump.

When the flow direction control devices 34, 35 and 37 are moved, to their positions at right angles to those shown in FIG. 2, so that they impede the flow of water through the water ducts 32 and 28 at the locations of said devices, and the flow device 36 is moved, as shown in FIG. 2, so that it permits a maximum flow of water through the water duct 30 at its location, water flows from the port pump water inlet 5 through the port pump 14 and thence through the center pump 16 to the center water outlet 9 whereby the vessel is powered by both said port pump and said center pump. When the flow control devices 38, 39 and 41 are moved to their positions at right angles to those shown in FIG. 2, so that they impede the flow of water through the water ducts 33 and 29 at the locations of said devices, and the flow device 40 is moved, as shown in FIG. 2, so that it permits a maximum flow of water through the water duct 31 at its location, water flows from the starboard pump water inlet 6 through the starboard pump 15 and thence through the center pump 16 to the center water outlet 9 whereby the vessel is powered by both said starboard pump and said center pump.

When the flow control devices 36 and 37 are moved, to their positions at right angles to those shown in FIG. 2, so that they impede the flow of water through the water ducts 30 and 28 at the locations of said devices, and the flow devices 34 and 35 are moved, as shown in FIG. 2, so that they permit a maximum flow of water through the water duct 32 at their locations, water flows from the port pump water inlet through the center pump 16, to the center water outlet 9, bypassing the port pump 14, whereby the vessel is powered solely by said center pump. When the flow control devices 40 and 41 are moved to their positions at right angles to those shown in FIG. 2, so that they impede the flow of water through the water ducts 31 and 29 at the locations of said devices and the flow devices 38 and 39 are moved, as shown in FIG. 2, so that they permit a maximum flow of water through the water duct 33 at their locations, water flows from the starboard pump water inlet 6 through the center pump 16 to the center water outlet 9, bypassing the starboard pump 15, whereby the vessel is powered solely by said center pump.

The vessel may thus be powered, as desired, by the port pump 14 solely, by the starboard pump 15 solely, by both the port and starboard pumps simultaneously, by the center pump solely, by the port pump and the center pump simultaneously, by the starboard pump and the center pump simultaneously, or by the port, starboard and center pumps simultaneously. This permits peak performance of the vessel, although 50% to 75% of its machinery is out of commission. It also permits the vessel to be steered by suitable bypassing of the port and starboard pumps 14 and 15. The propulsion system of the invention also permits bow and stern thrusters to be operated. The water inlets 5 and 6 and outlets 7, 8 and 9 may be positioned otherwise than as shown and described herein. The fuel saving permitted by the system of the invention is enormous and the use of bow and stern thrusters in forward and reverse permits many useful operations.

Figure 3:
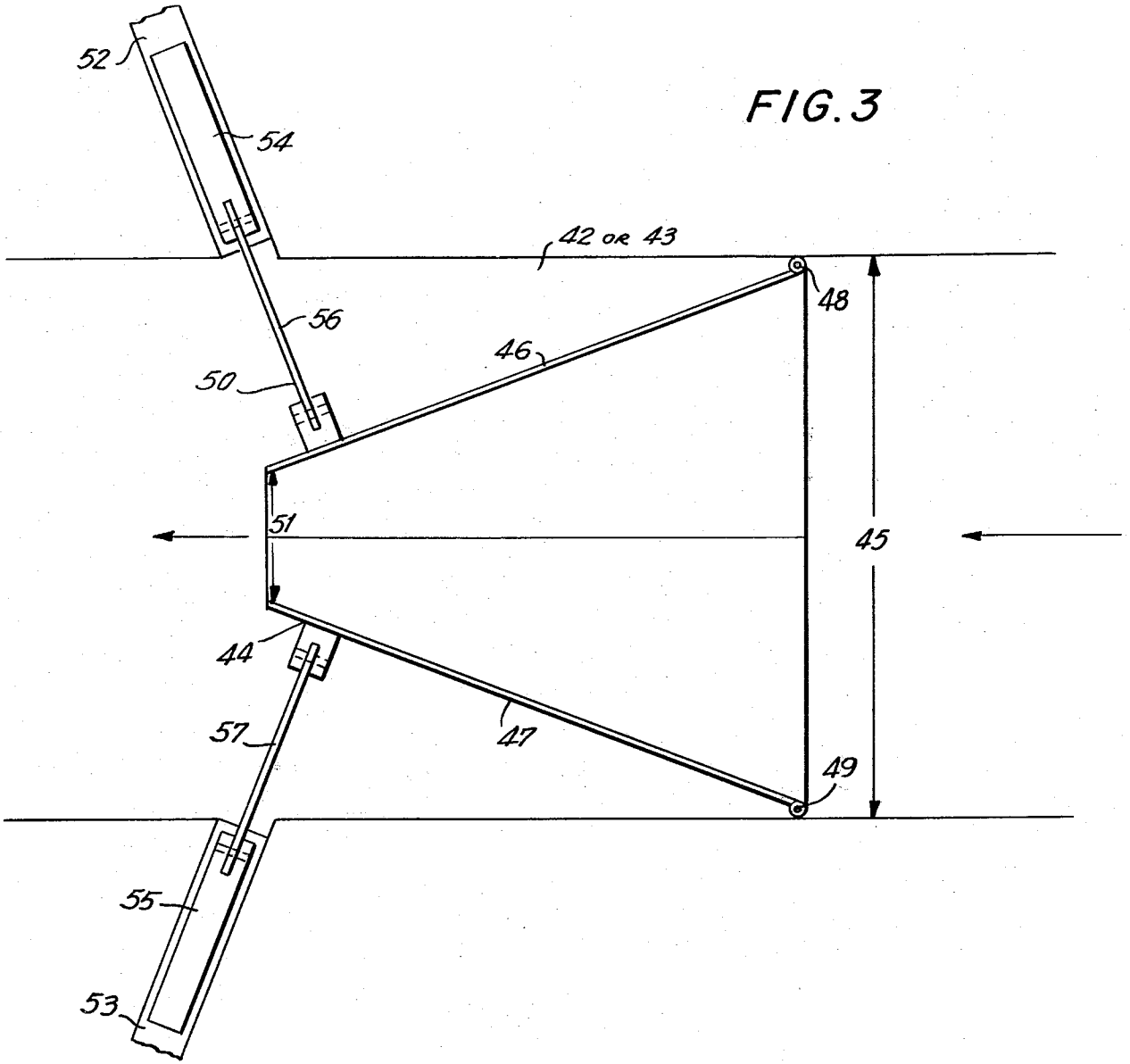
FIG. 3 is a schematic diagram, on an enlarged scale, of an embodiment of the flow area varying device of the propulsion system of the invention.

As shown in FIG. 2, the ducts 28 and 30 extend in common from a part 42 of the duct 28 and the ducts 29 and 31 extend in common from a part 43 of the duct 29. The third duct parts 42 and 43 have a predetermined cross-sectional flow area. A flow velocity control device 44, shown in detail in FIG. 3, is provided in each of the duct parts 42 and 43, as shown in FIG. 2, wherein said flow velocity control device is indicated in the duct part 43. The flow velocity control device functions to vary the velocity, at the cross sectional area 45 (FIG. 3) of water leaving the port pump 14 or water leaving the starboard pump 15. The flow velocity control device 44 may comprise any suitable components for selectively varying the velocity of water at the cross-sectional area 45. Thus, as shown in FIG. 3, the flow velocity control device 44 comprises a pair of plates 46 and 47 of any suitable configuration such as, for example, semifrustoconical or tapered trough-like plates which provide an orifice 51 through which the water is pumped. The plates 46 and 47 are movably or hingedly affixed to opposite points on the inside of the duct parts 42 and 43 via suitable fastenings or hinges 48 and 49, respectively. A flow velocity control system 50 is coupled to the flow velocity control device 44 for selectively varying the orifice 51 from a minimum area, shown in FIG. 3, whereby water flows to the center pump 16 and out the water outlet at a maximum velocity thereby providing a maximum vessel velocity, to a maximum area, opposite that shown in FIG. 3, and essentially equal to the cross-sectional area 45, whereby water flows to said center pump and out the water outlet at a minimum velocity thereby providing a minimum vessel velocity. The flow velocity control system may comprise any suitable system or device for selectively varying the orifice 51, in the aforedescribed manner. Thus, the flow velocity control system 50 is shown in FIG. 3 as comprising a pair of cylinders 52 and 53 affixed to opposite points on the inside of the ducts 42 and 43 and having a pair of pistons 54 and 55, respectively, axially movably mounted therein in the usual manner. The pistons 54 and 55 are coupled to the plates 46 and 47, respectively, via linking rods 56 and 57, respectively. Thus, the control of air or hydraulic fluid supplied to the cylinders 52 and 53 in a known manner, results in the selective movement of the plates 46 and 47 toward and away from each other.

While the invention has been described by means of a specific example and in a specific embodiment, I do not wish to be limited thereto, for obvious modifications will occur to those skilled in the art without departing from the spirit and scope of the invention.

I claim:

1. A propulsion system for hydrofoil, planing and semi-planing sea-going vessels, and the like, said vessels having a hull with a bow, a stern, a port side and a starboard side, said hull having a port pump water inlet formed therethrough on its port side, a starboard pump water inlet formed therethrough on its starboard side and first, second and third water outlets formed therethrough, said propulsion system comprising motive means in the hull;

a booster first stage system in the hull coupled to and driven by the motive means, said booster first stage system comprising a first axial water jet pump at the port pump water inlet for pumping water from said port pump water inlet and a second axial water jet pump at the starboard pump water inlet for pumping water from said starboard pump water inlet;

a second stage water jet system in the hull aft of the first stage system comprising a third axial water jet pump;

water duct means in said hull from each of the pump water inlets through the corresponding one of the first and second pumps to the corresponding one of the first and second water outlets, from each of the pump water inlets through the corresponding one of the first and second pumps and thence through the third pump, to the third water outlet, and from each of said pump water inlets through said third pump to said third water outlet, bypassing said first and second pumps;

flow direction control means for selectively directing a water flow through first and second pumps simultaneously, through said first pump solely, through said second pump solely, through said third pump solely, through said first and second pumps and said third pump simultaneously, through said first pump and said third pump simultaneously and through said second pump and said third pump simultaneously; and flow velocity control means for controlling the velocity of water pumped by each of said first and second pumps thereby controlling the velocity of water at said water outlets and, accordingly, the speed of the vessel, said flow velocity control means including first and second substantially tapered trough-like plates movably affixed to opposite points on the insides of said water duct means.

2. A propulsion system as claimed in claim 1, wherein said motive means comprises a first group of gas turbines, a second group of gas turbines, first means coupling the first group of gas turbines to said first and third pumps and second means coupling the second group of gas turbines to said second and third pumps.

3. A propulsion system as claimed in claim 1, wherein said flow direction control means includes a plurality of flow direction control means at a plurality of locations in said water duct means for controlling the direction and volume of water flowing through said water duct means at said locations.

4. A propulsion system as claimed in claim 1, wherein said water duct means from each of said first and second pumps to said first and second water outlets, respectively, comprises a first duct and said water duct means from each of said first and second pumps to said third pump comprises a second duct extending with the corresponding first duct in common from a third duct part at each of said first and second pumps, each of the third duct part having a predetermined cross-sectional flow area.

5. A propulsion system as claimed in claim 4, wherein said flow velocity control means are mounted in each of said third duct parts for varying the flow area of water leaving said first and second pumps.

6. A propulsion system as claimed in claim 1, wherein said flow velocity control means comprises said first and second plates for providing a variable orifice in said water duct means between said third pump and each of said first and second pumps, respectively.

* * * * *